United States Patent [19]

Stamper

[11] 4,085,882

[45] Apr. 25, 1978

[54] NAILING TOOL

[76] Inventor: Robert Stamper, 302 E. High St., Huntington, Ind. 46750

[21] Appl. No.: 771,440

[22] Filed: Feb. 24, 1977

[51] Int. Cl.[2] ..... B25C 1/02

[52] U.S. Cl. ..... 227/110; 227/147; 227/148; 227/156

[58] Field of Search ..... 227/110, 147, 148, 156

[56] References Cited

U.S. PATENT DOCUMENTS

| | | | |
|---|---|---|---|
| 677,155 | 6/1901 | Blankenburg | 227/147 |
| 2,199,833 | 5/1940 | Fleischman | 227/147 |
| 2,418,118 | 4/1947 | Hamilton et al. | 227/110 |
| 2,587,944 | 3/1952 | Williams | 227/147 |
| 3,008,361 | 11/1961 | Henning | 227/147 |
| 3,147,484 | 9/1964 | Nelson | 227/147 |

*Primary Examiner*—Granville Y. Custer, Jr.
*Attorney, Agent, or Firm*—Ronald D. Welch

[57] ABSTRACT

An improved and versatile nailing tool comprised of parallel and spaced-apart ramrod and nail feeding tubes intersecting adjacent one end thereof. A plurality of foot attachments are provided for accomodating different nailing situations, the attachments being removeably connected to one end of the ramrod tube. A ramrod is reciprocally contained within the ramrod tube. A nail deposited in the distal end of the nail feeding tube is guided into the ramrod tube in a position to be driven home.

7 Claims, 7 Drawing Figures

NAILING TOOL

BACKGROUND OF THE INVENTION

1. Field of the Invention

The field of the invention relates to nail driving tools, and more particularly, to such a nail driving tool which incorporates a plurality of interchangeable foot pieces or attachments to accomodate different nailing requirements.

2. DESCRIPTION OF THE PRIOR ART

Nailing devices for simplifying the driving of nails in a variety of construction and fabrication uses are known. Such prior art devices, however, are typically adapted for a single specialized use and do not have the ability of being applied to a number of different situations. For example, some prior art devices are adequate for conventional "rough" nailing operations, but cannot be used to drive a nail into a polished surface as they may mar the surface. The same can be said with respect to a nailing tool suitable for conventional nailing when one attempts to use it to "toenail" into side surfaces. Due to the lack of versatility on the part of the prior art, a user must purchase several different nailing tools when he desires to do a variety of nailing jobs. This increases the expense and inconvenience involved for the user who must perform a variety of nailing operations.

Prior art devices further have not adequately provided for storing a variety of nails proximate to the place where they are to be used and cannot accomodate a plurality of different sized nails, nor are they designed to prevent nails from being spilled therefrom during the operation or transport of the nailing tool.

SUMMARY OF THE INVENTION

It is an object of the invention to provide an improved nailing tool.

It is another object of the invention to provide a nailing tool having a plurality of nailing attachments.

Still another object of the invention is to provide a nailing tool which is easily adapted to a variety of different nailing applications.

It is another object of the invention to provide a nailing tool having a nail holder capable of holding a plurality of different sizes and types of nails.

The invention in its broader aspects is a nailing tool comprised of connected parallel and spaced-apart ramrod and nail feeding tubes. One end of the nail feeding tube angles toward and intersects the ramrod tube adjacent the aforementioned one end thereof. A ramrod is reciprocally contained within the ramrod tube. A plurality of foot attachments are interchangeably connected to the lower end of the ramrod tube to adapt the tool for a plurality of applications. Each of the foot attachments is provided with at least one positioning surface means for accurately locating the tool and thereby a nail driven by the tool even in otherwise inaccessible places.

A nail is driven by holding the nailing tool in position and dropping the nail down the distal end of the nail feeding tube. The nail travels through the nail feeding tube and into the ramrod tube into a position to be driven. A sharp descending blow is given to the ramrod to drive the nail home.

DESCRIPTION OF THE SPECIFIC EMBODIMENT

Figure 1:
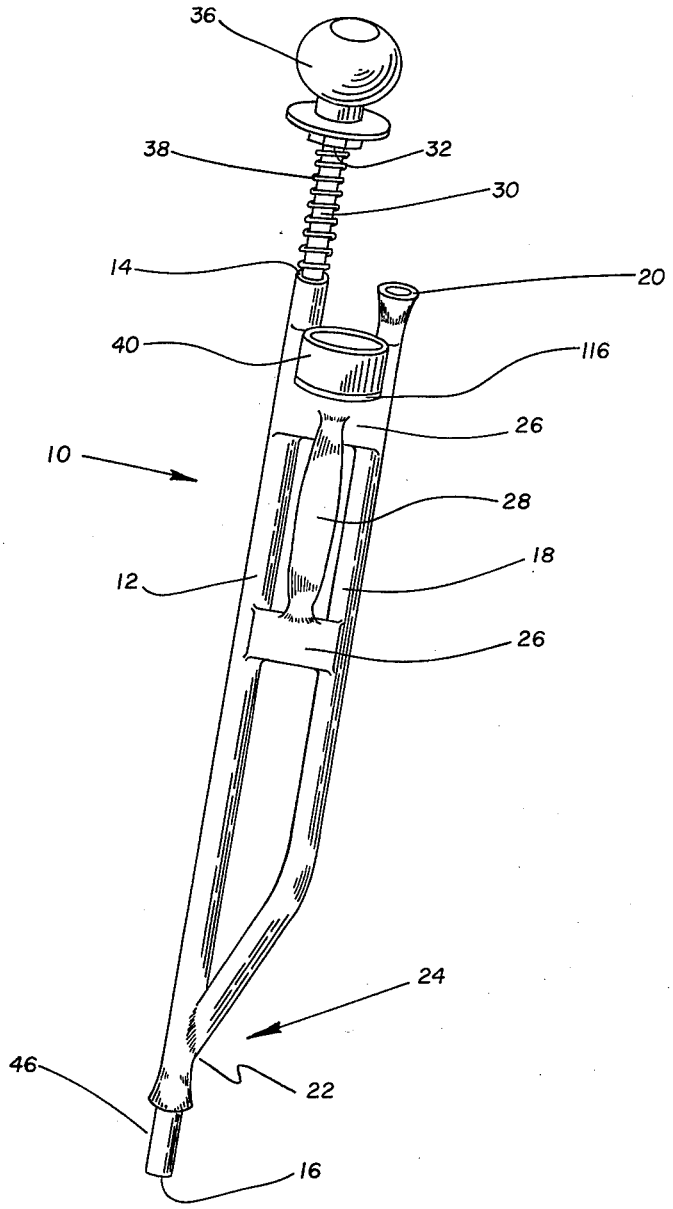
FIG. 1 is a perspective view of the improved nailing tool.

Referring to FIG. 1, there is illustrated a nailing tool 10, comprising elongated ramrod tube 12 having upper and lower ends 14 and 16, respectively, and elongated tube 18 having upper and lower ends 20 and 22 respectively. Ends 14 and 20 are about evenly positioned, and tubes 12 and 18 are positioned in a generally parallel, spacedapart relationship. At a point adjacent but spaced from end 16, end 22 of tube 18 angles inwardly and intersects tube 12 in a "Y" junction 24. Elongated tubes 12 and 18 are fixedly secured together by connector bars 26, and handle 28 is attached to nailing tool 10 via means such as welding to connector bars 26.

Figure 3:
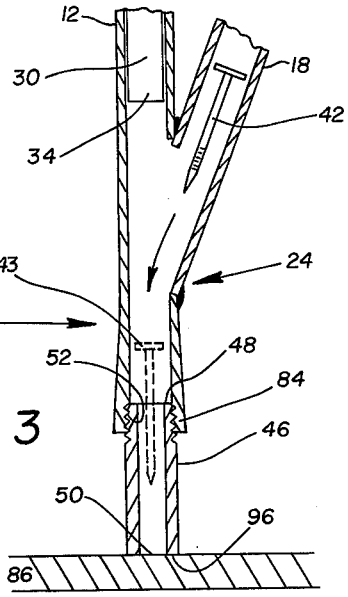
FIG. 3 is a cut away view of the lower end of the invention illustrated in FIG. 1 and showing the junction between the two tubes and the means for attaching the foot attachments.

As can best be seen in FIG. 3, tubes 12 and 14 have inside diameters dimensioned such that the enlarged or head portion of a nail 42 will pass freely therethrough. The inside diameters of tubes 12, 14 should be small enough to maintain a nail 42 received therein generally parallel to the axis of the tubes.

It should further be observed that the angle of intersection between tubes 12 and 14 is oblique and should be maintained at an angle such that a nail 42 passing from tube 18 into tube 12 does not jam, bind, or otherwise fail to pass into the lower portion of tube 12.

The lower end 16 of tube 12 is flared as at 29 and the inside surface of flared portion 29 is threaded whereby a selected one of a plurality of foot attachments such as attachment 46, to be described below, can be removeably secured thereto.

A ramrod 30 having opposite ends 32 and 34 is slideably received within tube 12. A weighted handle 36 for facilitating reciprocal movement of ramrod 30 is attached to end 32. Coiled spring 38 is received about ramrod 30, spring 38 being disposed between handle 36 and end 14. The length of ramrod 30 is greater than that of tube 12 so that, when the depression of handle 36 fully compresses spring 38, end 34 will protrude out from end 16 the full extent of the attachments, again to be described below. Handle 36 is also of a shape so as to conform with the operators hand, to facilitate manipulation thereof and not cause the operator any discomfort when he strikes a sharp descending blow thereon.

Cylindrical nail holder 40 is attached to nailing tool 10 adjacent ends 14 and 20 of tubes 12 and 18 respectively. The nail holder 40 may be provided with a magnetic floor 116 to keep any nails 42 contained therein from spilling out during the operation or transport of nailing tool 10. Alternately, the bottom portion of holder 40 may be filled with bees wax to hold the nails and further to provide lubrication of the nails when they are used. The open end of cylindrical nail holder 40 is of a sufficiently large diameter to allow many sizes of nails 42 to be held therein and to allow easy access to nails 42.

Figure 2A:
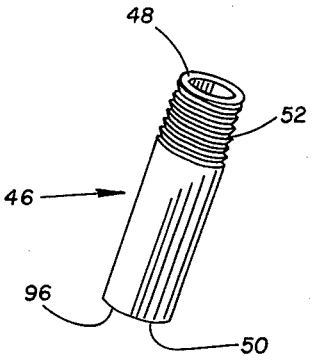
FIG. 2*a* is a perspective view of one nailing attachment.

Referring to FIG. 2*a*, a "straight" nailing foot attachment 46 is illustrated, attachment 46 comprising a tube having opposite ends 48 and 50. End 48 of attachment 46 is provided with threads 52 complimentary to the threaded portion 29 whereby, it will be observed that attachment 46 can be manually and detachably connected to end 16 of tube 12. It will be observed that the distance between end 50 af attachment 46 and the intersection 24 of tubes 12, 14 is such that a nail 42 will come to rest against a work piece 86 with its head 43 disposed below (as viewed in FIG. 3) the intersection 24. The lower annular surface 96 spaces and frictionally maintains the position of the tool. The nail 42 can now be driven into the workpiece 86 by means of the ramrod 30 and handle 36, the nail 42 being supported in a substantially vertical position by the side walls of tube 12 and attachment 46.

Attachment 46 is particularly useful when the tool 10 is to be used to drive nails into relatively inaccessible locations such as between closely spaced boards, between concrete forms and the like.

Figure 2B:
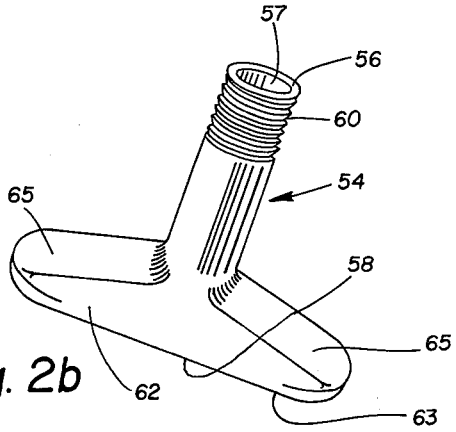
FIG. 2*b* is a perspective view of a foot attachment for use in driving nails in finish surfaces.

A second foot attachment is illustrated in FIG. 2*b*, this attachment being used to adapt tool 10 for driving finish nails or the like and wherein it is desired not to mark, mar or otherwise damage the surface into which the nail is being driven. Attachment 54 is provided with opposite ends 56, 58, end 56 again being threaded so that it can be detachably secured to the end 16 of tube 12. Similarly, attachment 54 is provided with a cylindrical hole 57 extending therethrough and communicating with the opposite ends 56, 58 thereof. End 58 is provided with an enlarged flange portion 62. The lower surface 63 of flange portion 62 is flat and smooth such that it will not mark or otherwise damage the surface of a workpiece (not shown). The enlarged flange portion, because of the enlarged surface area 63 thereof, distributes the shock of the hammer blows over a wider area. Further, because the flange portion is elongated, the spacing between the hole 57 thereof and a suitable reference object such as a floor or wall can be effectively maintained by rotating the tool until one of the ends 65 thereof rests against the reference object. Thus, surface 63 and the ends 65 of flange portion 62 function to locate the tool. By maintaining the tool in this position, the point at which a nail will be driven into the workpiece (not shown) can be accurately maintained without otherwise having to press the end of the nailing tool 10 against the workpiece and increasing the possibility of damage thereto.

Figure 2C:
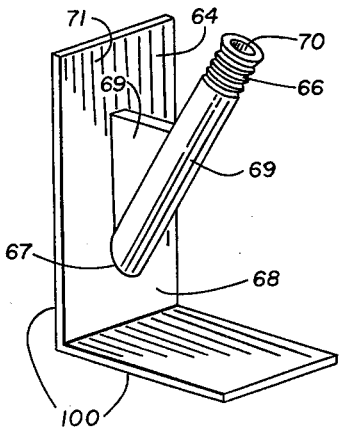
FIG. 2*c* is a perspective view of a toe nailing foot attachment of the invention.

Referring now to FIG. 2*c*, there is illustrated a toenailing attachment 64. Attachment 64 again includes a tubular portion 69 having a threaded end 66 complimentary to threaded portion 29 of tube end 16. The tube portion 69 has its distal end 67 cut at an angle and is fixedly secured to the vertical leg 71 of a right angle member 68 by means of welding and a brace 69. Again, a cylindrical opening 70 of substantially the same diameter as the inside diameter of tube 12 extends tubular portion 69, angle member 68 similarly having an opening (not shown) therethrough aligned with the opening 70.

Attachment 64 is, as with the other attachments, threadedly attached to portion 29 of tube 12. In use, the angle member 68 is abutted with surfaces 100 thereof against a stud and base member (not shown) thereby positively positioning the tool 10 both in spacing and angle with respect to the workpiece to drive a toenail into the two workpieces. While the tubular member 69 is shown in a position lying on a plane perpendicular to the upwardly extending leg 71 of angle member 68, it will be apparent to those skilled in the art that this tubular portion 69 may be angled with respect to such a plane to thereby position the ram rod 30 and other portions of the tool 10 more advantageously for use in driving toenails between closely spaced vertical members.

Figure 2D:
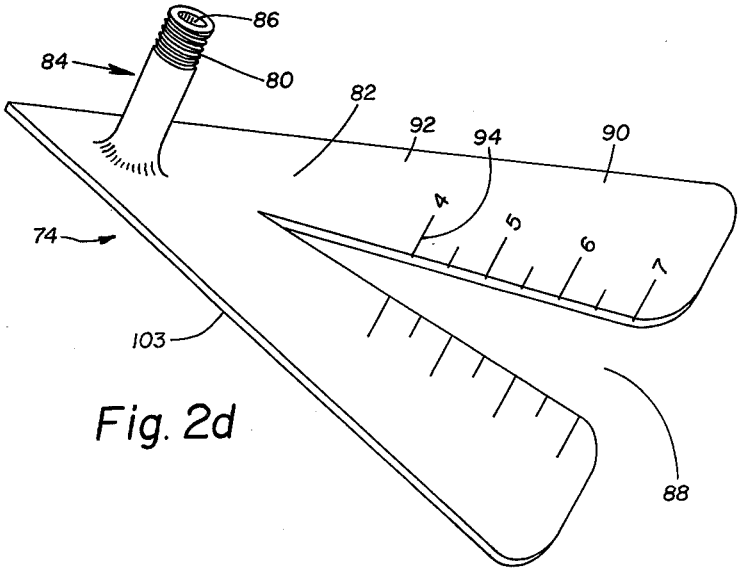
FIG. 2*d* is a perspective view of a foot attachment of the invention for use in flooring and surface nailing applications.

Referring now to FIG. 2*d*, there is illustrated now a floor nailing attachment 74. Attachment 74 includes an enlarged, generally triangular base 82 having a tubular portion 84 fixedly secured thereto in upstanding relationship. Portion 84 is again tubular having an opening 86 extending therethrough with a similar opening (not shown) being provided in the base member 82. Tubular portion 84 is threaded as at 80 so that it can be detachably secured to the threaded portion 29 of tube 12. A slot 88 is formed through the heel end 90 and the upper surface 92 of the base 82 is provided with calibrated indicia 94 which indicate the distance between the tubular portion 84 and the respective indicia. With attachment 74 secured to the tool 10, the tool can be firmly positioned and held with the foot. Using indicia 94, the spacing between a desired reference point and the point at which the nail will be driven by the tool 10 is clearly indicated, such being especially useful when installing floors, firing strips and the like.

Figure 2E:
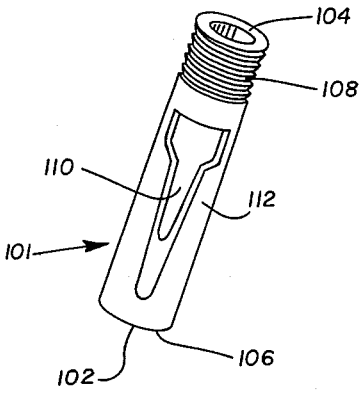
FIG. 2*e* is a perspective view of a foot attachment having an auxiliary nail feeding opening for use when the tool is being used in a generally horizontal orientation.

Referring now to FIG. 2*e*, there is illustrated yet another attachment 101 for use with the tool 10. Attachment 101 is similar to attachment 46 and comprises a tubular member 102 having opposite ends 104, 106. End 104 is threaded as at 108 whereby it may be detachably secured to the tool threaded portion 29. However, attachment 101 is further provided with an elongated opening at slot 110 in the side or wall surface 112 thereof. Opening 110 is dimensioned such that a nail, such as nail 42 (FIG. 3) can be inserted directly thereinto. This attachment is particularly useful when the tool is used in a horizontal orientation such that nails otherwise placed into the tube 14 would not be drawn by gravity into the lower portion of ramrod tube 12 to be driven into the workpiece. It will be seen that each of the foot attachments provides both a means for guiding the nail 42 when it is in driving position (as shown in dashed lines in FIG. 3) and further includes at least one surface, i.e. surfaces 96, 63, 100, 103, and 106 which function to position or otherwise locate the tool 10 and thereby the nails being driven with the tool.

In overall operation, the user retrieves a nail 42 from the holder 40 and places it into the end 20 of tube 18. The nail 42 simply slides down the tube 18 and exits therefrom into tube 12 at the "Y" junction 24 therebetween when ramrod 30 is raised.

The ramrod 30 is now moved upwardly (as viewed in FIG. 1) and the nail can now be driven into the workpiece by one or a plurality of hammer blows until it is properly driven home. Additionally, the end 20 of tube 14 can be either flared as shown in FIG. 1 or provided with a suitable enlarged funnel portion to further facilitate the insertion of nails into the tube 18.

From the above description it will be seen that the invention is highly versatile due to the plurality of nailing attachments available and the ease with which they may be attached to the tool. Each of the attachments is relatively simple and inexpensive and can be easily transported with the tool. Using such a tool, a worker or user, has only to purchase a single tool with a plurality of nailing attachments and will be thereby enabled to perform a plurality of nailing operations with greater ease and accuracy. The tool itself is relatively light and portable.

Utilizing the tool in accordance with the present invention, a single worker is provided with a tool which greatly facilitates driving nails into difficult positions and in a variety of applications. The single tool performs all of the operations with a simple interchange of one of the attachment devices.

While there have been described above the principles of this invention in connection with specific apparatus, it is to be clearly understood that this description is made only by way of example and not as a limitation to the scope of the invention.

What is claimed is:

1. A nailing tool comprising an elongated ram rod tube having upper and lower ends and a smooth, uniform internal bore dimensioned to coaxially and slideably receive a nail therein, means for feeding nails into said lower end into a nailing position substantially coaxial therewith, said nail feeding means including an elongated nail feeding tube having an inside diameter dimensioned to slideably and coaxially receive a nail therein and being fixedly secured to said ram rod tube in generally parallel spaced-apart relationship thereto, one end of said nail feeding tube being angled inwardly and intersecting said ram rod tube at an oblique angle, the interior of said nail feeding tube and the interior of said ram rod tube forming a smooth junction, whereby, a nail deposited into said nail feeding tube will pass therethrough into said nailing position, ram rod means including a ram rod for driving a nail in said nailing position into a work piece, said ram rod being reciprocally moveable in said ram rod tube between retracted and nail striking positions, and being complementary to the bore of said ram rod tube, said ram rod closing said junction when in said striking position, said junction being open when said ram rod is in said retracted position to thereby permit a nail held in said feeding tube to pass into said nailing position, foot attachment means removeably secured to said lower end, and including at least one positioning surface for locating said tool with respect to said workpiece, and thereby a nail being driven by said tool, a nail holder fixedly secured to said tool adjacent the upper end of said ram rod tube, said nail holder including an open container having a magnetic surface, nails deposited in said holder being removeably retained therein by said magnet.

2. The tool of claim 1 wherein said foot attachment means includes a tubular extension disposed in axial alignment with said ramrod tube, a plate member fixedly secured to the distal end of said tubular extension in a position substantially transverse with respect thereto, a cylindrical opening extending through said tubular extension and said plate, said plate having thereon a plurality of indicia means for indicating the distance of a nail in said nailing position with respect to each said indicia.

3. The tool of claim 1 wherein said foot attachment means includes a tubular extension disposed in axial alignment with said ram rod tube and an angle bracket having vertical and horizontal legs, said tubular extension being fixedly secured to said vertical leg and disposed at a predetermined angle with respect thereto, an opening extending through said tubular extension and said vertical leg and communicating with interior of said ram rod tube, a nail in said nailing position being positioned at an angle with respect to a vertical workpiece abutted against said vertical leg whereby, said nail will be toenailed thereinto when driven.

4. The tool of claim 1 wherein said foot attachment means includes a tubular extension disposed in axial alignment with said ram rod tube, an elongated flange fixedly secured to the distal end of said tubular extension, the surface of said flange facing oppositely of said tubular extension being smooth and polished, whereby, said elongated flange can be located to rest against a reference object to thereby locate said tool, said smooth polished surface preventing marking of said workpiece when said nail is being driven.

5. The tool of claim 1 wherein said foot attachment includes a tubular extension disposed in axial alignment with said ram rod tube, said positioning surface being anular and of minimum cross-section thereby permitting the locating of said nailing position in otherwise closely spaced, inaccessible locations.

6. The tool of claim 5 wherein said means for feeding nails includes an elongated slot formed through the side wall of said tubular extension.

7. A nailing tool comprising an elongated ram rod tube having upper and lower ends, means for feeding nails into said lower end into a nailing position substantially coaxial therewith, ram rod means including a ram rod for driving a nail in said nailing position into a workpiece, said ram rod being reciprocally moveable in said ram rod tube between retracted and nail striking positions, and being complementary to the bore of said ram rod tube, said ram rod closing said junction when in said striking position, said junction being open when said ram rod is in said retracted position to thereby permit a nail held in said feeding tube to pass into said nailing position, foot attachment means removeably secured to said lower end, and including at least one positioning surface for locating said tool with respect to said workpiece, and thereby a nail being driven by said tool, a nail holder fixedly secured to said tool adjacent the upper end of said ram rod tube, said holder including an open container filled with bees wax, nails placed in said container being removeably retained therein by said bees wax, said bees wax providing lubrication for said nails when being driven.

* * * * *